United States Patent [19]

Ono et al.

[11] 4,261,046

[45] Apr. 7, 1981

[54] TIMEPIECE

[75] Inventors: Tsuneyoshi Ono; Toshimasa Ikegami, both of Suwa, Japan

[73] Assignee: Kabushiki Kaisha Suwa Seikosha, Tokyo, Japan

[21] Appl. No.: 14,447

[22] Filed: Feb. 23, 1979

[30] Foreign Application Priority Data

Feb. 23, 1978 [JP] Japan ..... 53-20321

[51] Int. Cl.[3] ..... G04B 19/24; G04B 27/00; G04B 19/20; G04B 3/00

[52] U.S. Cl. ..... 368/35; 368/31; 368/28

[58] Field of Search ..... 58/4 A, 58, 23 D; 368/28, 31, 32, 34, 35, 36, 37

[56] References Cited

U.S. PATENT DOCUMENTS 3,815,351 6/1974 Vovelle ..... 58/4 A 3,855,785 12/1974 Ushikoshi ..... 58/58

*Primary Examiner*—J. V. Truhe

*Assistant Examiner*—John B. Conklin

*Attorney, Agent, or Firm*—Blum, Kaplan, Friedman, Silberman and Beran

[57] ABSTRACT

In an analog timepiece having calendar displays for day and date, a transducer operating independently of the hand driving transducer, feeds, that is, updates the calendar wheels automatically on a daily basis. Synchronization of the daily day and date changes is provided by a twenty-four hour wheel cooperating with the timekeeping mechanism. For setting the calendar displays, turning the stem in one direction polarizes a magnet and advances the day wheel, while turning the stem in the other direction reverses the polarity of the magnet and advances the date dial until desired settings are accomplished. The date advancing transducer can be automatically actuated for end of the month date adjustments.

14 Claims, 3 Drawing Figures

TIMEPIECE

BACKGROUND OF THE INVENTION

This invention relates generally to electronic analog timepieces and more particularly to an electronic analog timepiece having calender displays for day and date in addition to the conventional hands for the display of the time-keeping functions. Generally in a timepiece of the prior art having a calendar wheel, it requires two or three hours to feed, that is, update the date dial and the day star wheel. Feeding of these wheels usually occurs between the hours of 9 p.m. and midnight on the dial. During this transient period, a date finger and a finger for the day of the week within the mechanism of the timepiece are engaged with the date calendar dial and the day star wheel. It is generally impossible to correct or manually set the calendar device during that period. If the watch is forceably and inherently carelessly corrected, the engaged parts are damaged. Another disadvantage of the calendar wristwatches of the prior art is the impracticability to read the date and the day during the period when the calendar wheels are being fed or updated. During that transient period only a portion of the date characters and the day numerals are visible through the small windows which are provided on the face of the wristwatch.

To this degree the analog display watch, having a date dial and a day star wheel, is inferior to a watch having digital displays using the liquid crystals or light emitting diodes. The day and date are easily set by manual operations for an electronic digital display since there is no mechanical devices which may be damaged in the process. Also the analog display watch is deficient in that the timepiece has to be corrected for date at the end of the month once in every two months during the year. With a digital display electronic watch, there is no need to correct the watch at the end of the month because the integrated circuit is designed to automatically make these adjustments throughout the year.

Until the present time, many improvements have been conceived in order to eliminate the manual date correction required at the end of the month in prior art wrist watches. But these conceptual designs have been too complicated to be realized in a practical embodiment.

What is needed is an electronic analog timepiece having calendar displays for day and date, which may be readily set at any time of any day. It is also desirable that the daily updating of day and dates occur rapidly, over a short period of time at the end of each day. Automatic end of month adjustments for the number of days in the month is also desirable.

SUMMARY OF THE INVENTION

Generally speaking, in accordance with the invention, an electronic analog timepiece having calendar displays of day and date which automatically change rapidly at the end of each day and are easily set manually, is provided. In the analog timepiece of this invention having calendar displays for day and date, a transducer operating independently of the hand driving transducer, feeds, that is, updates the calendar wheels automatically on a daily basis. Synchronization of daily day and date change is provided by a twenty-four hour wheel cooperating with the time keeping mechanism. For setting the calendar wheels, turning the stem in one direction polarizes a magnet and advances the day wheel, while turning the stem in the other direction reverses the polarity of the magnet and advances the date dial until desired settings are accomplished. The date advancing transducer can be automatically actuated for end of month date adjustments.

Accordingly, it is an object of this invention to provide an electronic analog timepiece having calendar displays of date and day, which updates automatically at the end of the day in a very short time period.

Another object of this invention is to provide an electronic analog timepiece having calendar displays for day and date wherein the calendar display is easily set at any day and date without the need to advance the hands in the process.

A further object of this invention is to provide an electronic analog timepiece having calendar displays for day and date, wherein the day or the date may be set independently of the other.

Still another object of this invention is to provide an electronic analog timepiece having calendar displays for day and date with means for manually setting the day and date which are entirely independent of the means for time keeping and the time-keeping display.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 1A:
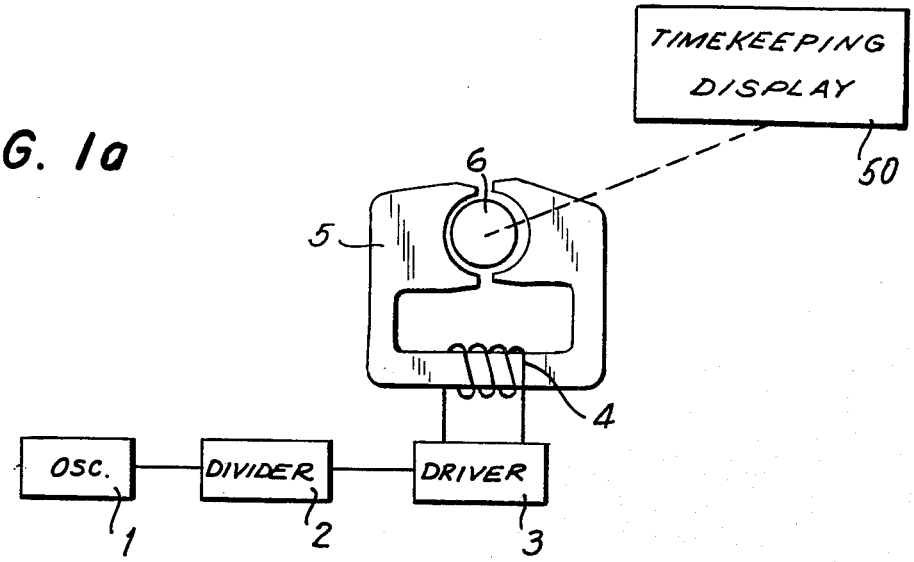
FIG. 1*a* is a partial functional block diagram of the timepiece of this invention showing the time-keeping functions.

FIG. 1*a* is a functional diagram of the time-keeping portion of the timepiece of this invention. The oscillator circuit 1 uses a quartz crystal vibrator or the like as a time standard source of high frequency signals. In the known manner, the high frequency output of the oscillator 1 is broken down in the divider network to produce a low frequency signal at the output of 1 Hz. The 1 Hz signal from the divider network 2 is applied to the driving circuit 3 which provides the signals for moving the hour hand, a minute hand and a second hand on the face of the timepiece. The mechanical movement of the hands is initiated by a step motor comprising the coil 4 which receives the output signal from the driving circuit 3 for driving the rotor 6 once per second. The stator 5 is a generally U-shaped integral single component with a core made of a highly permeable magnetic material which carries the magnetic field generated as a result of the signals induced in the coil 4. The rotor 6 is comprised of a permanent magnet. Rotation of the rotor 6 as a result of the signals applied from the driver 3 to the coil 4, is transmitted to the hour wheel 20 (FIG. 2) through an intermediary driving gear train, cannon pinion, minute wheel etc., all in the well-known manner of analog timepieces. The aforementioned driving gear train, cannon pinion, and minute wheel, etc., have been omitted from FIG. 2 for the sake of clarity and because these components are not novel portions of this invention.

Figure 1B:
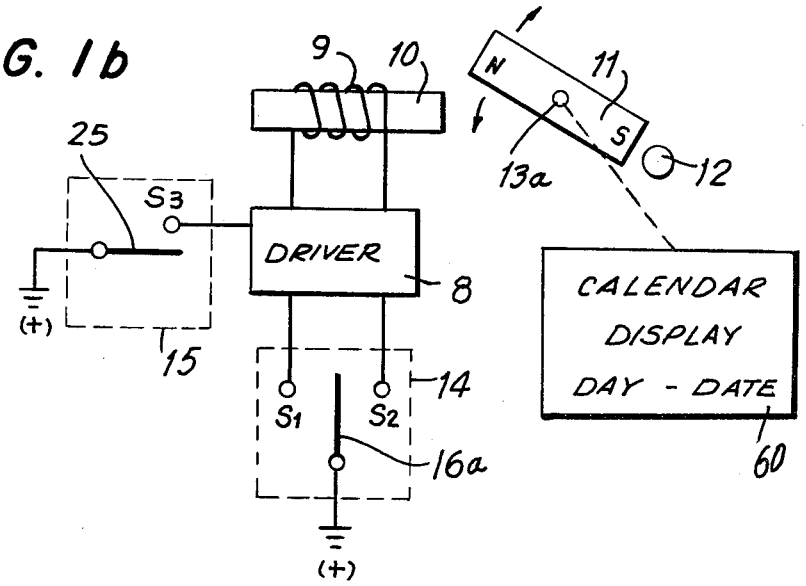
FIG. 1*b* is a partial functional block diagram of the timepiece of this invention showing the calendar functions.

FIG. 1*b* is a functional block diagram of the calendar portion of the subject timepiece. The driving circuit 8, completely independent of the driver 3 in the time-keeping diagram described above, provides the signals which cause the date dial 17 and day star wheel 18 (FIG. 2) to be advanced. There are two modes of operation for the calendar display 60. The normal operating mode is entirely automatic with the date and day as seen on the face of the watch changing at the end of the 24th hour of the day. The day and the date are advanced by one day in normal operation with the last date in the month being followed by the first date of the next month.

In the second mode of operation, the user manually sets either or both of the date or day displays.

Figure 2:
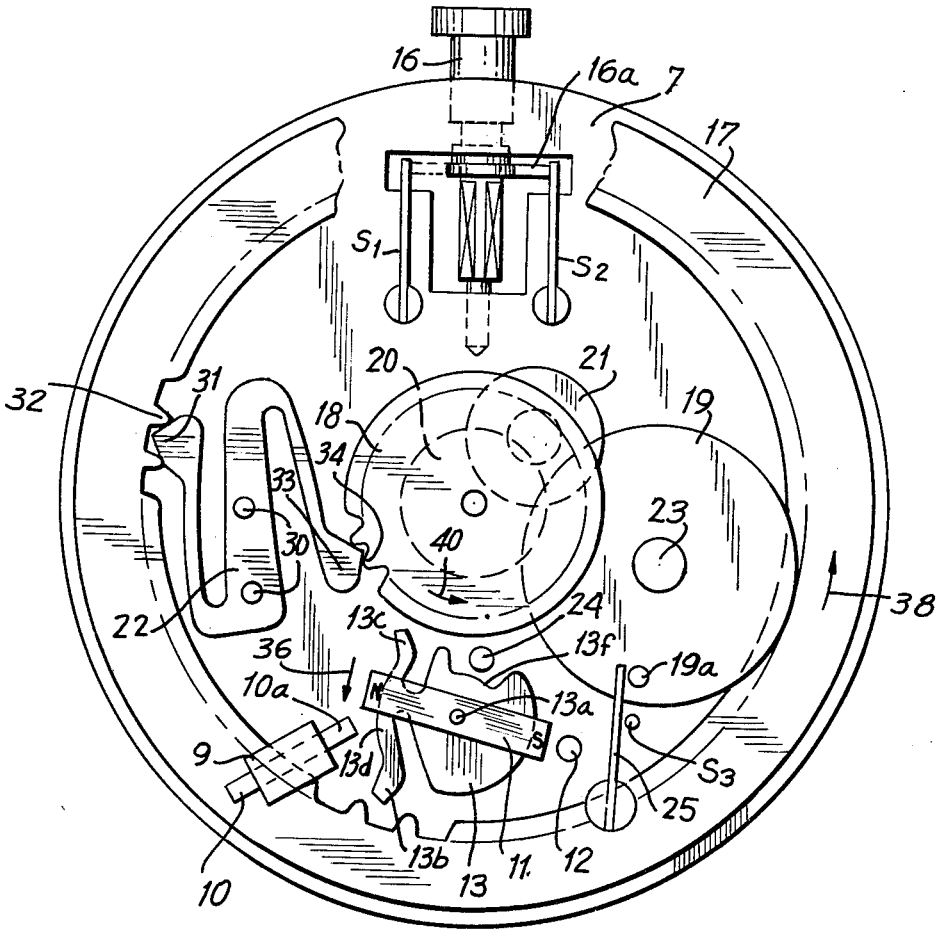
FIG. 2 is a plan view, with parts omitted, of the internal mechanism of the timepiece of this invention.

In the calendar setting mode, the driving circuit 8 applies to the calendar advancing coil 9 an output signal which advances the date after manual rotation of the stem 16 in one direction, and which advances the day after rotation of the stem 16 in the other direction. In the normal calendar feeding mode, that is, updating at the end of one day and the beginning of the next day, an output signal from the driver 8 advances the displays by one date and one day in every twenty-four hours. The coil 9 for calendar advancement receives signals put out by the driving circuit 8 both for updating the calendar in the normal calendar feeding mode and for setting desired day and date on the face in the calendar setting mode of operation. The magnetic core 10 for calendar advancement is made of highly permeable magnetic material. The permanent magnet 11 is mounted for oscillation on the central pin 13*a*. As best seen in FIG. 2, the permanent magnet 11 is fixedly attached and integral with the calendar advancing member 13. The drawing pin 12 is magnetically permeable and determines the position of the permanent magnet 11 when no signals are applied to the coil 9 from the driver 8. The drawing pin 12 is fixed to the base plate 7 of the timepiece and thus the permanent magnet 11, when inactive, has its south pole attracted to the pin 12.

The switch means 14 has terminals $S_1$ and $S_2$ which are electrically isolated from, but physically attached to the base plate 7. The switching lever 16*a*, which is the pole of a single pole - double throw switching means 14, is affixed to the grounded stem 16 (FIG. 2). In the calendar setting mode, the date is corrected when the stem 16 is rotated to the right (FIG. 1*b*) and the switching lever 16*a* connects with the terminal $S_2$. When the stem 16 is rotated to the left (FIG. 1*b*), the switching lever 16*a* connects to the terminal $S_1$ of the switching means 14 and the day is corrected on the face of the watch. Thus, date setting and day setting are distinquished by the direction of rotation of the stem 16. As explained more fully hereinafter the calendar advancing driving circuit 8 is actuated to produce an output whenever contact is made with terminal $S_1$ or $S_2$ due to manual operation of the stem 16.

Closing of the contacts in the second switch means 15 applies a signal output from the calendar driving circuit 8 to the calendar advancing coil 9 in the conventional mode of daily changes in date and day as displayed on the face of the timepiece. The second switch means 15 is also used to update the day and date dials when the hands of the timepiece are being set in a manual operation. The switching means 15 include the switching resilient member 25 which is grounded to the base plate 7, and the terminal $S_3$, electrically isolated from the base plate 7 but physically attached thereto. The projection 19*a* on the synchronizing wheel 19 operates the switching resilient member 25.

FIG. 2 is a plan view with parts omitted showing mechanically the calendar feeding and setting mechanisms shown functionally in FIGS. 1*a* and *b*. As stated above, many of the mechanical components related purely to the time-keeping functions and which are not novel parts of this invention are omitted from FIG. 2. Also it should be understood that the face of the timepiece of this invention including the minute, second, and hour hand has also been omitted in this view which is primarily an interior view. It should be understood that rectangular openings in the watch face will permit the observation of a single day and date which are in registry with the openings in the face of the timepiece. This is a well-known practice in wrist watches for display of calendar functions such as day and date, although it is not limited to these functions exclusively. The calendar advancing coil 9 is physically attached to the base plate 7, with the calendar advancing magnetic core 10 passing through magnetic coil 9. The calendar advancing member 13 comprises the shaft 13*a* about which the permanent magnet 11 pivots. The calendar advancing member 13 also includes the recessed portions 13*f*, the date finger, 13*b*, and day finger 13*c* and the permanent magnet 11 which is rigidly joined to the calendar advancing member 13.

The drawing pin 12 is fixed to the base plate 7 in such a position that the date finger 13*b* and the day finger 13*c* do not engage the date dial 17 and the day star wheel 18 respectively. Hereinafter this condition is referred to as the neutral position. This neutral position is a normal standby condition when the day and date are not being fed or manually set. The synchronizing wheel 19 drives the hour wheel 20 by rotation of the rotor 6 transmitted through an intermediary driving gear train and cannon pinion (not shown).

The jumper 22 is attached at a center portion, for example, by means fo the rivets 30, to the base plate 7. One end 31 of the jumper 22 engages with the teeth 32 on the date dial 17, and the other end 33 of the jumper 22 engages with the teeth 34 on the day star wheel 18. The jumper performs the same function in this watch as in the conventional prior art calendar wrist watch. The jumper 22 is resilient and in calendar setting and feeding operations, the extended arms of the jumper 22 flex and provide no substantial impediment to the rotational motion of the date dial 17 and the day star wheel 18. When the date dial 17 and the day star wheel 18 are not driven, whether automatically or manually, the jumper 22 by its engagement with these wheels as stated above, maintains the date dial 17 and the day star wheel 18 in fixed positions. Thus the calendar displays are stationary until driven.

It should be noted that the switching lever 16*a* described above, is one part of the stem 16 of the timepiece of this invention.

Operation is fully explained hereinafter with reference to FIGS. 1 and 2. The synchronizing wheel 19 is driven so as to rotate once in every twenty-four hours.

This wheel 19 rotates in synchronism with the hour wheel 20 in accordance with the action of the conventional time keeping functions as shown in FIG. 1*a* and the conventional intermediary mechanical mechanisms. In the calendar feeding or updating operational mode, the switching resilient member 25 is flexed by the projection 19*a* on the synchronizing wheel 19 and contacts the terminals S3 in the second switch means 15. A predetermined duration of contact between the switching resilient member 25 and the projection 19*a* causes the calendar advancing coil 9 to have applied thereto a signal put out by the calendar driving circuit 8. Upon the occurence of this first output signal, the end 10*a* of the calendar advancing magnetic core 10 is magnetized as a south pole. The attractive force between this generated south pole and the north pole at one end of the permanent magnet 11, causes the member 13 for calendar advancement to rotate in the direction indicated by the arrow 36. This causes the end 13*b* of the member for calendar advancement 13 to engage a tooth 32 on the date dial 17 and to cause the date dial 17 to rotate by an angular distance in the direction of arrow 38 representative of one day as seen in the rectangular opening (not shown) in the face of the watch.

When the signal from the driver 8 ceases, the member 13 returns to the neutral position where it is once again attracted by the interaction of the south pole of the permanent magnet 11 and the drawing pin 12. By the return of the member 13 to the neutral position, the date finger 13*b* disengages from the teeth 32 on the date dial 17, aided by the resilience in the connecting arm 13*d*. Because of this construction, there is no danger that the date dial 17 will be drawn back when the member 13 returns to its neutral position.

Immediately thereafter, and automatically, a reverse signal is put out by the calendar driving circuit 8 and is applied to the calendar advancing coil 9. This reverse signal provides a reverse current as compared to the previously described date advancing signal. The end 10*a* of the calendar advancing core 10 is magnetized as a north pole, and the member 13 for calendar advancing rotates in a direction opposite to the arrow 36. By this rotation, the end 13*c* of member 13 engages a tooth 34 on the day star wheel 18 and drives the day star wheel 18 in the direction indicated by the arrow 40. This signal from the driver 8 advances the day star wheel by one day as seen on the face of the watch. When the output signal from the driver 8 ceases, the member 13 for calendar advancement is reset to the neutral position where the south pole of the permanent magnet 11 is attracted to the drawing pin 12. This return to the neutral position is accomplished without any return motion of the day star wheel. It should be noted that in an alternative embodiment of this invention, the day may be displayed in at least two ways, for example, the day Sunday may be displayed as SUN or DIM (French) which both mean Sunday. Where two languages alternate on the day wheel, the number of output signals from the driver 8 for driving the day star wheel 18 equals the number of languages which are used on the day wheel. Thus for the normal automatic operation of the calendar wheel only one language will be consistently displayed in the day display.

As stated above, in the normal operating condition, the calendar advancing driving circuit 8 is adapted to discriminate the condition when the switching resilient member 25 contacts the terminal $S_3$ by reason of some external physical disturbance, from the condition when the switching resilient member 25 is contacting the terminal $S_3$ by the normal rotation of the synchronizing wheel 19 in order to put out the signals to move the calendar display. The length of time of contact between the switching resilient member 25 and the projection 19*a* is evaluated in the driver circuit 8 in order to respond only to those signals produced by rotation of the synchronizing wheel 19.

In the calendar setting operation, when the stem 16 is manually rotated in one direction, the switching lever 16*a* connects to the terminal $S_1$ which causes the calendar advancing circuit 8 to output a signal by which the end 10*a* of the calendar advancing core 10 is magnetized as a south pole. As described above, this condition causes the date dial 17 to be driven by one circular increment to change the date. When the stem 16 is rotated in the opposite direction, the switching lever 16*a* contacts the terminal $S_2$ and the calendar advancing circuit 8 outputs a signal by which the end 10*a* of the calendar correcting magnetic core 10 is magnetized as a north pole. As described above, in this condition the day star wheel is advanced to show the next day on the face of the dial.

Further, when the stem 16 is continuously rotated in one direction, the stem 16 slips relative to the switching lever 16*a* but the switching lever is in continued contact with the terminal $S_1$ or $S_2$ depending on the direction of rotation. In this condition the day or the date can be successively corrected over certain intervals.

The member 13 has an oscillatory motion. The pin 24 fixed in the recessed portion 13*f* of the member 13 and attached to the plate 7 limits the rotation of the calendar advancing member 13 in both the calendar setting operation and in the normal automatic calendar feeding or updating operation. When the hands (not shown) are advanced in the usual manner by extracting the stem 16 and then rotating the stem 16, the switching lever 16*a* is disengaged from the stem 16. However rotation of the hands, by intermediary gearing (not shown), causes the synchronizing wheel 19 to rotate such that the projection 19*a* interacting with the switching resilient member 25 causes the calendar display to advance as the hands pass through midnight.

In an alternative embodiment of this invention, there is included a wheel synchronizing the years and discriminating the months having 30 days from the months having 31 days. Switch means disposed near this wheel are adapted to connect the calendar advancing circuit 8 at the end of the month having 30 days, whereby the calendar display of dates is advanced an extra step to skip a display of the numeral 31 on the face of the dial. Thus manual calendar correcting operations at the end of the 30-day month can be eliminated.

Here, the driving circuit 3 for applying the output signals to drive the hands, and the calendar advancing driving circuit 8 for applying the output signal for setting and feeding the calendar displays, are separately used. But even if these two circuits 3, 8 are put together into one integrated driving circuit, and a synchronizing means is provided between the hands and the calendar as described above, the hands can be synchronized to the date, day, month and year and the calendar displays can be instantaneously advanced. Also the morning and the afternoon periods are easily displayed by advancing the day wheel both at midnight and at noon and showing the same day characters against different color backgrounds to distinquish morning and afternoon.

It should be obvious from the description above, that the use of individual transducers for time keeping and for operation of the calendar displays provides a great deal of flexibility in presenting the calendar displays.

It will thus be seen that the objects set forth above, among those made apparent from the preceding description, are efficiently attained and, since certain changes may be made in the above construction without departing from the spirit and scope of the invention, it is intended that all matter contained in the above description are shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A timepiece for both time-keeping and calendar functions, comprising:

means for time keeping and first transducer means for driving a time display;

calendar means including at least day and date displays, said date display being formed in a ring, said day display having a day star wheel, said star wheel and said date ring being disposed with a space therebetween and including a second transducer;

means for setting said display including day and date fingers disposed in said space for selectively engaging said day and date displays when driven by said second transducer and changing said day and date displays; and synchronizing means cooperating with said time-keeping and said calendar means for periodically coordinating the updating of said calendar displays with the time of day said synchronizing means actuating said second transducer, said second transducer driving said day and date fingers for updating, said fingers and said second transducer produce both setting and updating.

2. The timepiece of claim 1, wherein said means for setting operates independently of said means for coordinating the updating of said calendar displays.

3. The timepiece of claim 2 wherein said means for setting is adapted to provide the independent setting of said day display and independent setting of said date display.

4. The timepiece of claim 3 wherein said independent settings are performed by manual operation of an external member.

5. The timepiece of claim 3 wherein said means for independent setting includes switch means cooperating with said second transducer, said switch means when in a first operating mode causing said day display to be advanced by said second transducer, said switch means when in a second operating mode causing said date display to be advanced by said second transducer, and when said switch means is not in said first or second operating modes, said calendar displays are controlled by said synchronizing means.

6. A timepiece for both time-keeping and calendar functions, comprising:

means for time keeping and first transducer means for driving a time display;

calendar means including at least day and date displays, and including a second transducer for driving and changing said day and date displays;

synchronizing means between said time-keeping and said calendar means for coordinating the updating of said calendar displays with the time of day;

means for setting said calendar displays; said means for setting including switch means cooperating with said second transducer, said switch means when in a first operating mode causing said day display to be advanced by said second transducer, said switch means when in a second operating mode causing said date display to be advanced by said second transducer, and when said switch means is not in said first or second operating mode, said calendar displays being controlled by said synchronizing means;

said second transducer having an electro magnet in a fixed position, said electro magnet being polarized in one direction when said switch means is in said first operating mode, and said electro magnet being polarized in the other direction when said switch means is in said second operating mode;

a permanent magnet, said permanent magnet being pivotably mounted and attracted to said electro magnet when said electro magnet is polarized, said permanent magnet pivoting in one direction when said electro magnet is polarized in one direction, and said permanent magnet pivoting in the other direction when said electro magnet is polarized in the other direction, said electro magnet being non-polarized and said permanent magnet being in a neutral position when said switch means is not in said first or second operating mode;

means for engaging said date dial and said day star wheel, said means for engaging moving with said pivoting permanent magnet and engaging and advancing said date dial when said switch means is in said first operating mode, and engaging and advancing said day star wheel when said switch means is in said second operating mode.

7. The timepiece of claim 6 wherein said means for engaging includes at least one finger pivoting with said permanent magnet, and teeth on said date dial and said day star wheel, said at least one finger engaging said date dial teeth when said permanent magnet is pivoted in one direction, and said at lease one finger engaging said day star wheel teeth when said permanent magnet is pivoted in the other direction.

8. The timepiece of claim 1 or 7 wherein said synchronizing means includes a binary switch actuated by said time keeping means for updating of said calendar displays, said updating occurring at regular intervals of time, closing said binary switch causing said second transducer to output signals consecutively advancing said day and date displays.

9. The timepiece of claim 8 and further comprising an analog display of time, and said synchronizing means includes a wheel rotating at one revolution per day, at least one projection on said rotating wheel contacting and closing said binary switch for an interval during each revolution.

10. The timepiece of claim 1, 3, 5 or 7 and further comprising an analog display of time.

11. The timepiece of claim 9 wherein said switch means is operated manually by said external member.

12. The timepiece of claim 12 wherein said external member is a stem, turning said stem in one direction inducing said first operating mode in said switch means, turning said stem in the other direction inducing said second operating mode in said switch means.

13. The timepiece of claim 1 and further comprising an hour wheel driven by said first transducer, said date ring, and said day star wheel being driven solely by said second transducer.

14. The timepiece of claim 1, wherein said date ring and said day star wheel are concentrically disposed and said space therebetween is generally annular.

* * * * *